US010411414B2

(12) United States Patent
Zhu et al.

(10) Patent No.: US 10,411,414 B2
(45) Date of Patent: Sep. 10, 2019

(54) ELECTRICAL CONNECTOR WITH STACKED SHIELDING PLATES SANDWICHED BETWEEN TWO OPPOSITE CONTACT MODULES

(71) Applicant: FOXCONN INTERCONNECT TECHNOLOGY LIMITED, Grand Cayman (KY)

(72) Inventors: Jian-Kuang Zhu, Kunshan (CN); Wei Zhong, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/105,954

(22) Filed: Aug. 20, 2018

(65) Prior Publication Data

US 2019/0058293 A1 Feb. 21, 2019

(30) Foreign Application Priority Data

Aug. 18, 2017 (CN) ..... 2017 1 0712338

(51) Int. Cl.
*H01R 13/648* (2006.01)
*H01R 13/6597* (2011.01)
(Continued)

(52) U.S. Cl.
CPC ..... *H01R 13/6597* (2013.01); *H01R 13/504* (2013.01); *H01R 13/405* (2013.01);
(Continued)

(58) Field of Classification Search
CPC ..... H01R 13/6585; H01R 13/405; H01R 13/504; H01R 13/6597; H01R 24/60; H01R 2107/00
(Continued)

(56) References Cited

U.S. PATENT DOCUMENTS 2,472,747 A * 6/1949 Jones ..... H05K 9/002 174/378
4,440,463 A * 4/1984 Gliha, Jr. ..... H01R 13/6582 439/92
(Continued)

FOREIGN PATENT DOCUMENTS

CN 205141284 U 4/2016
CN 107681371 A 2/2018

*Primary Examiner* — Abdullah A Riyami
*Assistant Examiner* — Vladimir Imas
(74) *Attorney, Agent, or Firm* — Wei Te Chung; Ming Chieh Chang

(57) ABSTRACT

A high frequency electrical connector includes a housing with first and second rows of contacts therein. The housing includes a base and a mating tongue extending forwardly from the base. Each contacts has a contacting section exposed upon the mating surface of the mating tongue, a connection section exposed out of the base, and a middle section therebetween. The first row of contacts as well as the second row of contacts includes a plurality of grounding contacts. First and second shielding plates stacked with each other and commonly between the first row of contacts and the second row of contacts. The first shielding plate and the second shielding plate form corresponding spring tangs offset from each other in the front-to-back direction to respectively contact the first grounding contacts and second grounding contacts at different positions in the front-to-back direction.

20 Claims, 11 Drawing Sheets

(51) Int. Cl.

| | |
|---|---|
| ***H01R 13/504*** | (2006.01) |
| *H01R 13/6585* | (2011.01) |
| *H01R 107/00* | (2006.01) |
| *H01R 24/60* | (2011.01) |
| *H01R 13/405* | (2006.01) |

(52) U.S. Cl.
CPC ..... *H01R 13/6585* (2013.01); *H01R 24/60* (2013.01); *H01R 2107/00* (2013.01)

(58) Field of Classification Search
USPC ..... 439/607.05
See application file for complete search history.

(56) References Cited

U.S. PATENT DOCUMENTS 5,257,949 A * 11/1993 Paulus ..... H01R 13/7197 333/185
7,828,597 B1 * 11/2010 Jin ..... H01R 13/6471 439/607.05
8,337,249 B2 * 12/2012 Lappoehn ..... H01R 13/6585 439/607.55
8,808,029 B2 * 8/2014 Castillo ..... H01R 13/6585 439/607.05
9,178,319 B2 * 11/2015 Little ..... H01R 13/6585
9,281,626 B2 * 3/2016 Lin ..... H01R 13/6581
9,281,643 B1 * 3/2016 Tseng ..... H01R 13/518
9,306,336 B2 * 4/2016 Chang ..... H01R 13/6471
9,401,570 B2 * 7/2016 Phillips ..... H01R 13/6585
9,461,378 B1 * 10/2016 Chen ..... H01R 12/707
9,461,412 B2 * 10/2016 Yu ..... H01R 13/6585
9,461,415 B2 * 10/2016 Guo ..... H01R 13/41
9,520,683 B2 * 12/2016 Qian ..... H01R 13/6585
9,525,241 B1 * 12/2016 Su ..... H01R 13/6581
9,564,716 B2 * 2/2017 Kao ..... H01R 13/6586
9,640,923 B2 * 5/2017 Kao ..... H01R 12/724
9,653,849 B2 * 5/2017 Hsu ..... H01R 13/6585
9,673,569 B2 * 6/2017 Zhang ..... H01R 13/6585
9,685,751 B2 * 6/2017 Yu ..... H01R 13/405
9,722,369 B1 * 8/2017 Hsu ..... H01R 24/60
9,728,899 B2 * 8/2017 Peng ..... H01R 13/6581
9,735,512 B2 * 8/2017 Hsu ..... H01R 13/6596
9,780,496 B2 * 10/2017 Guo ..... H01R 13/405
9,799,999 B1 * 10/2017 Tsai ..... H01R 12/57
9,853,399 B2 * 12/2017 Kao ..... H01R 13/6585
9,929,513 B2 * 3/2018 Wang ..... H01R 13/6591
9,972,945 B1 * 5/2018 Huang ..... H01R 13/6585
9,997,871 B2 * 6/2018 Zhong ..... H01R 24/28
10,027,063 B2 * 7/2018 Peng ..... H01R 12/594
10,027,066 B2 * 7/2018 Zhong ..... H01R 13/6597
10,038,286 B2 * 7/2018 Zhu ..... H01R 13/6585
10,044,148 B2 * 8/2018 Zhao ..... H01R 13/6581
10,050,373 B2 * 8/2018 Wang ..... H01R 13/5219
10,063,014 B2 * 8/2018 Wen ..... H01R 13/04
10,135,197 B2 * 11/2018 Little ..... H01R 12/58
10,141,693 B2 * 11/2018 Zhao ..... H01R 13/405
10,199,775 B2 * 2/2019 Zhao ..... H01R 13/6585
10,199,777 B2 * 2/2019 Zhao ..... H01R 13/6585
10,211,554 B2 * 2/2019 Zhou ..... H01R 12/716
10,211,563 B2 * 2/2019 Zhao ..... H01R 12/724
10,236,632 B2 * 3/2019 Zhang ..... H01R 13/50
2002/0061669 A1 * 5/2002 Yu ..... H01R 13/6582 439/95
2014/0024257 A1 * 1/2014 Castillo ..... H01R 13/6585 439/607.05
2016/0064866 A1 * 3/2016 Kao ..... H01R 13/6471 439/676
2016/0352050 A1 * 12/2016 Hu ..... H01R 13/6597
2018/0166830 A1 * 6/2018 Feng ..... H01R 13/6593

* cited by examiner

ELECTRICAL CONNECTOR WITH STACKED SHIELDING PLATES SANDWICHED BETWEEN TWO OPPOSITE CONTACT MODULES

BACKGROUND OF THE INVENTION

1. Field of the Invention

The present invention relates to a high frequency electrical connector, and particularly to the electrical connector with stacked shielding plates sandwiched between a pair of contact modules wherein each shielding plate includes at least one spring tang mechanically and electrically connecting to one grounding contact. This instant application relates to a copending application with the same applicant, the same filing date and the same title thereof.

2. Description of Related Art

Using a spring tang punched out of a metallic plate to contact a grounding contact for enhancing grounding effect, is essentially a popular method. Anyhow, when such a metallic plate is shared by multiple items thereabouts, it is relatively difficult to provide sufficient grounding structures in the limited space thereabouts.

It is desired to have an electrical connector with sufficient metallic structures to provide sufficient shielding and/or grounding effect thereabouts.

SUMMARY OF THE INVENTION

An object of the invention is to provide a high frequency electrical connector with a housing with first and second rows of contacts therein. The housing includes a base and a mating tongue extending forwardly from the base. Each contacts has a contacting section exposed upon the mating surface of the mating tongue, a connection section exposed out of the base, and a middle section therebetween. The first row of contacts as well as the second row of contacts includes a plurality of grounding contacts. First and second shielding plates stacked with each other and commonly between the first row of contacts and the second row of contacts. Each shielding plate has at least one row of spring tangs wherein the spring tangs of the first shielding plate with regard to the corresponding grounding contacts of the first row of contacts are essentially offset from the spring tangs of the second shielding plate with regard to the corresponding grounding contacts of the second row of contacts in a top view so as to assure the superior shielding effect in the vertical direction, compared with the single layer shielding plate arrangement.

Other objects, advantages and novel features of the invention will become more apparent from the following detailed description when taken in conjunction with the accompanying drawings.

DETAILED DESCRIPTION OF THE PREFERRED EMBODIMENT

Figure 1:
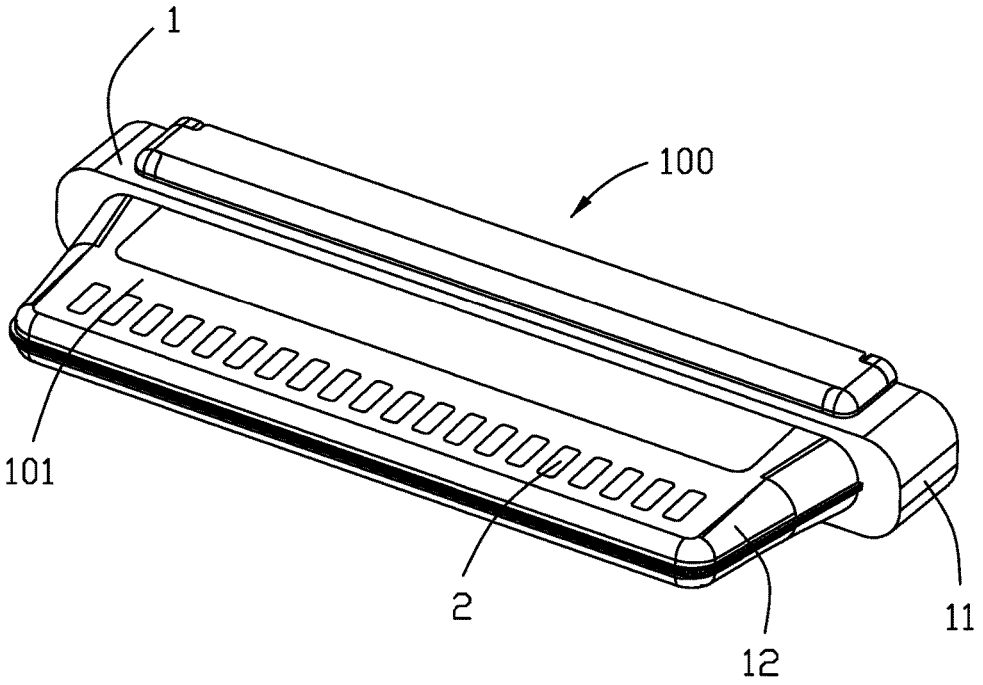
FIG. 1 is a perspective view of an electrical connector according to the invention.
Figure 2:
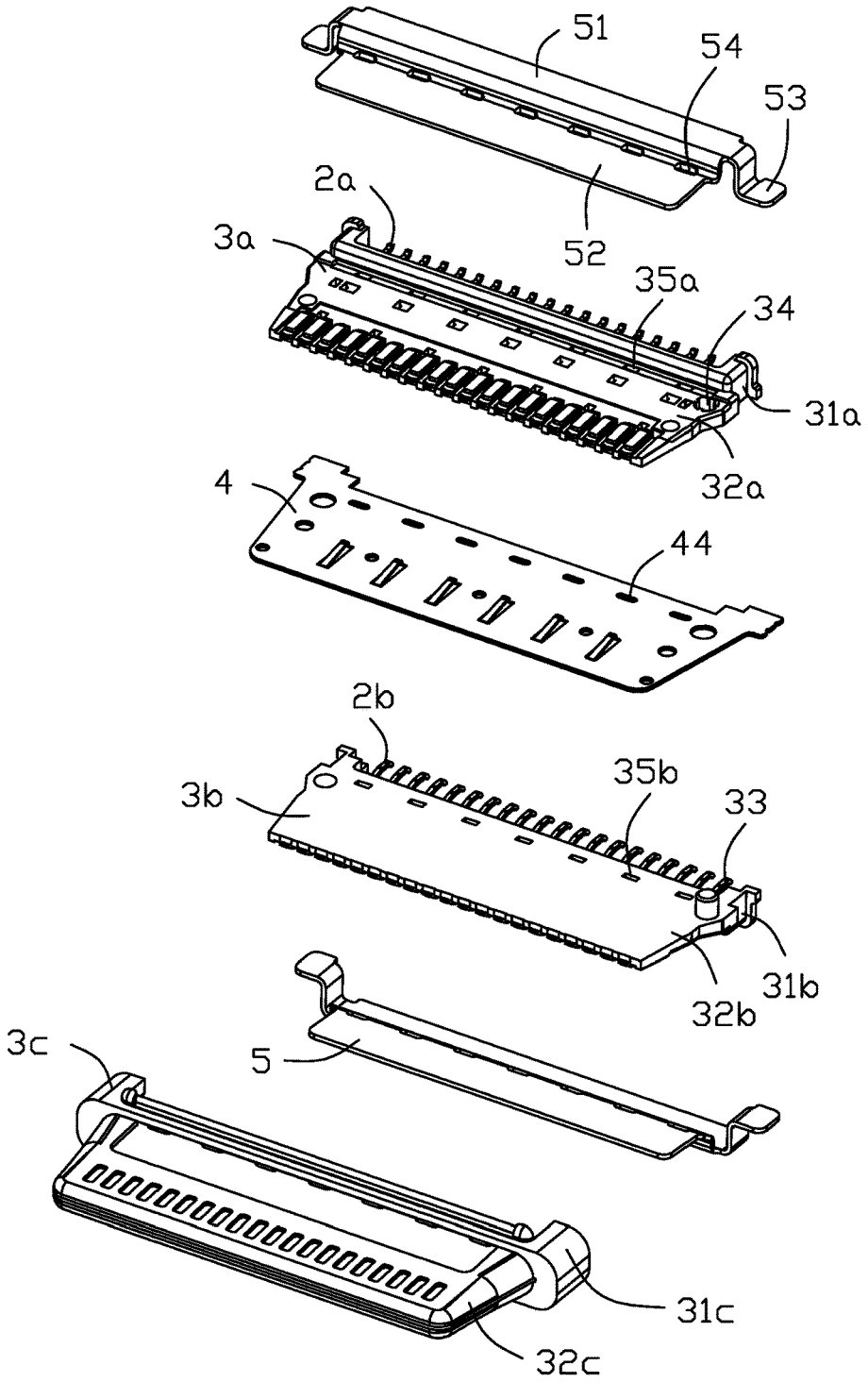
FIG. 2 is an exploded perspective view of and the corresponding contacts of the electrical connector of FIG. 1.
Figure 3:
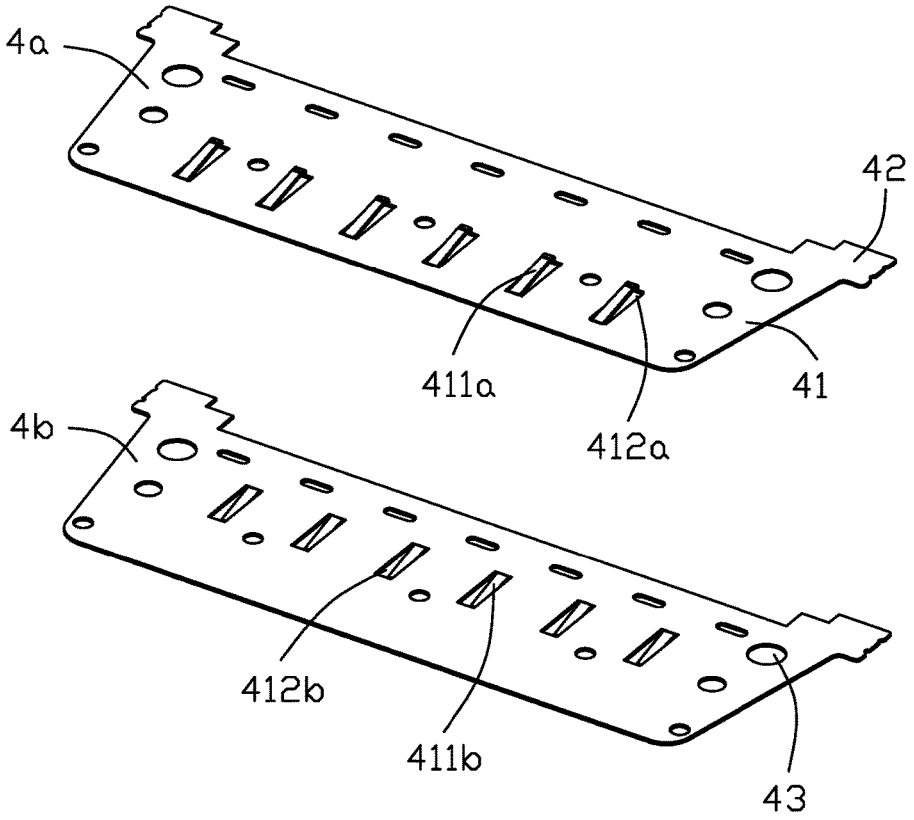
FIG. 3 is an exploded perspective view of the shielding plates of the electrical connector of FIG. 1.
Figure 4:
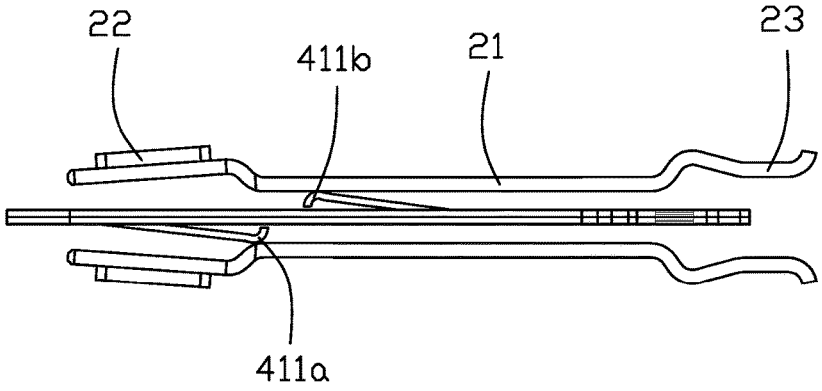
FIG. 4 is an upside-down side view of the stacked shielding plates with the associated contacts of the electrical connector of FIG. 1.
Figure 5:
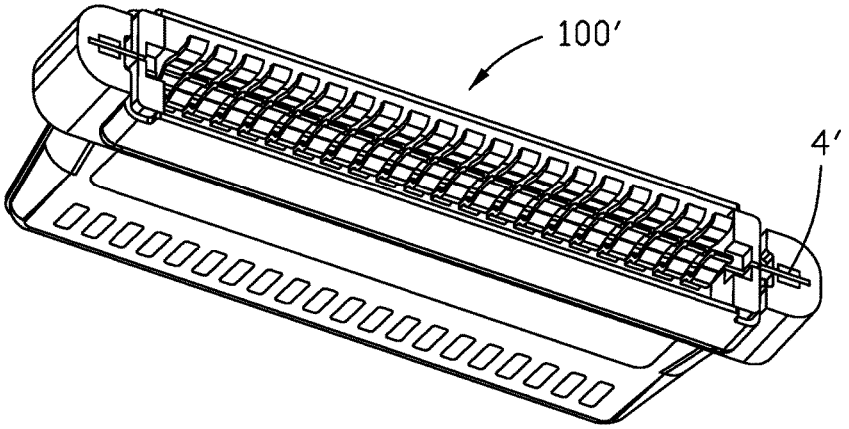
FIG. 5 is a perspective view of another embodiment of the electrical connector.
Figure 6:
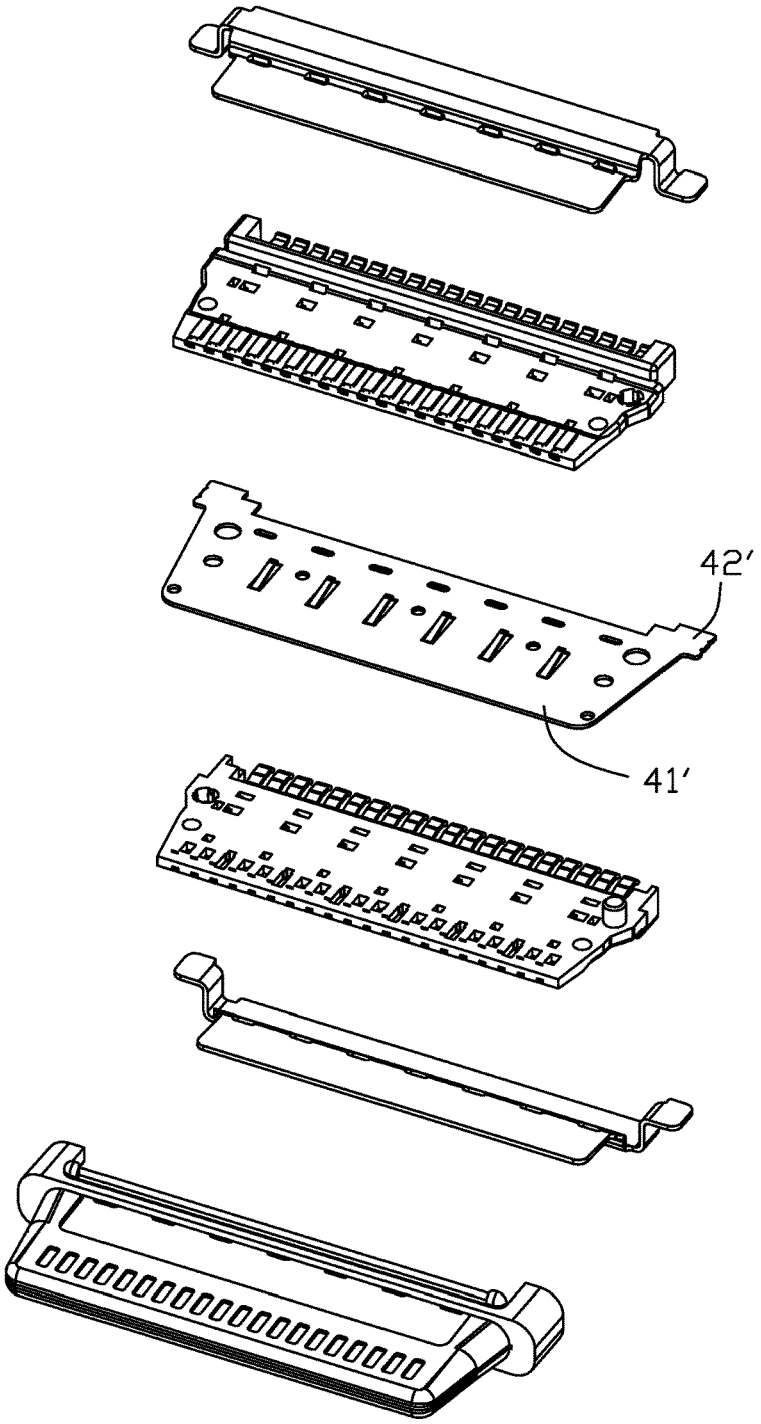
FIG. 6 is an exploded perspective view of the electrical connector of FIG. 5.
Figure 7:
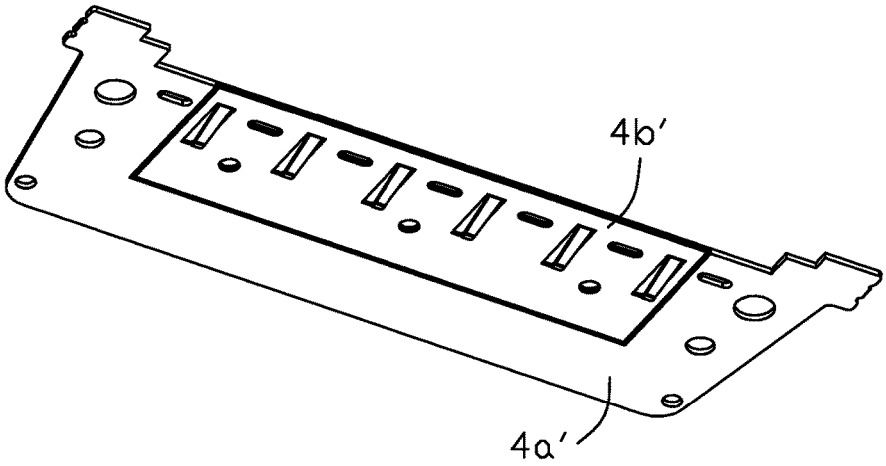
FIG. 7 is a perspective view of the shielding plates of the electrical connector of FIG.
Figure 8:
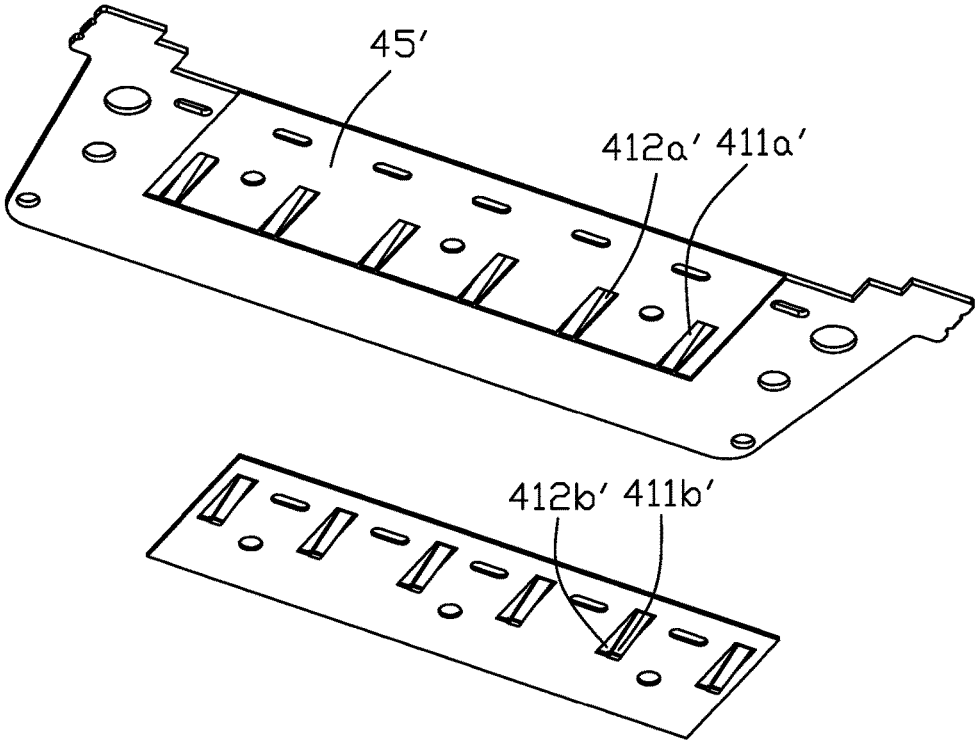
FIG. 8 is an exploded perspective view of the shielding plates of the electrical connector of FIG. 7.
Figure 9:
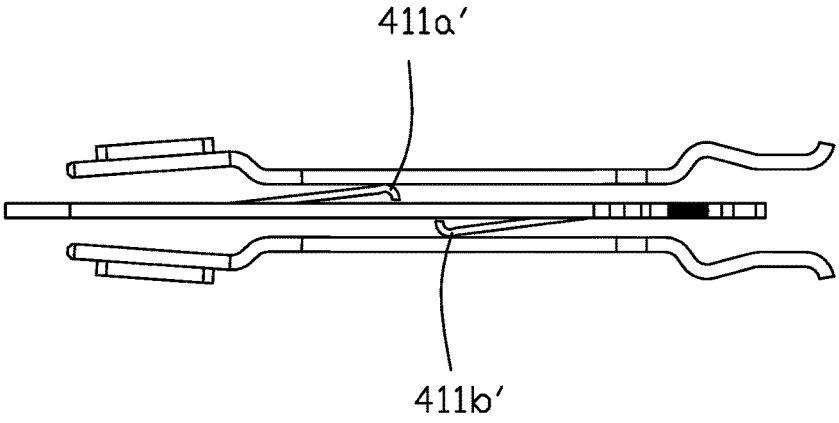
FIG. 9 is a side view of the shielding plates with the corresponding grounding contacts of the electrical connector of FIG. 6.

Referring to FIGS. 1-4, the electrical connector 100 includes an insulative housing 1 and a plurality of contacts 2 retained therein. The housing 1 includes a base 11 and a mating tongue 12 extending forwardly from the base 11 and having opposite mating surfaces 101. Each contact 2 has a contacting section 22 exposed upon the mating surface 101, a tail section 23 and a connecting section 21 therebetween.

The contacts 2 are arranged with first contacts 2*a* and second contacts 2*b*. The first contacts 2*a* are integrally formed within the first insulative block 3*a* via an insert-molding process, and the second contacts 2*b* are integrally formed within the second insulative block 3*b* via another insert-molding process. The first contacts have a plurality of first grounding contacts, and the second contacts are as well. The first insulative block 3*a* includes a first base 31*a* and a first mating tongue 32*a* extending from the first base 31*a*. The second insulative block 3*b* includes a second base 31*b* and a second mating tongue 32*b* extending from the second base 31*b*. Each mating tongue 32*a*, 32*b* has a positioning post 33 and a positioning hole 34 wherein the positioning post 33 of the first insulative block 3*a* is inserted into the positioning hole 34 of the second insulative block 3*b*, and the positioning post 33 of the second insulative block 3*b* is inserted into the positioning hole 34 of the first insulative block 3*a* so as to assemble the first insulative block 3*a* and the second insulative block 3*b* together.

The electrical connector 100 further includes a metallic shielding plate composed of a first shielding plate 4*a* and a metallic second shielding plate 4*b* stacked with each other in the vertical direction and commonly sandwiched between the first insulative block 3*a* and the second insulative block 3*b*. Each of the first shielding plate 4*a* and the second shielding plate 4*b* include a main body 41 and a pair of fixing legs 42 on two lateral sides. The main body 41 of the first shielding plate 4*a* forms around a front portion thereof a plurality of first spring tangs 411*a* in one row and the corresponding first openings 412*a* derived from forming the first spring tangs 411*a*. The main body 41 of the second shielding plate 4*b* forms around the middle portion a plurality of second spring tangs 411*b* and the corresponding second openings 412*b*. The first/second spring tang 411*a*, 411*b* respectively extend from corresponding inner edges of the corresponding first/second opening 412*a*, 412*b* away from the shielding plate 4 either toward or away from each other. Each first/second shielding plate 4*a*, 4*b* has the hole 43 for extension of the positioning post 33. The first shielding plate 4*a* and the second shielding plate 4*b* are fixed together via either soldering or welding. Because the first spring tangs 411*a* and the second spring tangs 411*b* are offset from each other in the front-to-back direction, the first openings 412*a* will be covered by the second shielding plate 4*b*, and the second openings 412*b* will be covered by the first shielding plate 4*a*. Therefore, there is no EMI leak between the first contacts 2*a* and the second contacts 2*b*. During assembling, the positioning post 33 of the first insulative block 3*a* and that of the second insulative block 3*b* extend through the holes 43 of the shielding plate 4 into the positioning holes 34, respectively, so as to fix the first insulative block 3*a*, the shielding plate 4 and the second insulative block 3*b* together. The first spring tang 411*a* contacts the connecting section 21 of the first grounding contact of the first contacts 2*a*, and the second spring tang 411*b* contacts the connecting section 21 of the second grounding contact of the second contacts 2*b*.

A pair of metallic shells 5 are attached upon the housing 1. Each shell 5 includes a blade 51 and an extension 52 extending from the blade 51 to the shielding plate 4, and a pair of legs 53 extending from the blade in an offset manner. The pair of shells 5 are respectively attached upon the exterior of the first insulative block 3 and second insulative block 4, respectively. The legs 53 abut against the corresponding legs 42, respectively. The first insulative block 3*a*, the second insulative block 3*b* and the shielding plate 4 are commonly loaded into the mold for an overmolding process wherein the metal shell 5, the first insulative block 3*a*, the shielding plate 4 and the second insulative block 3*b* have the positioning hole 554, 35*a*, 44 and 35*b* so as to allow the corresponding core pins to extend therethrough during the overmolding process. A third insulative block 3*c* is applied upon the first insulative block 3*a*, the shells 5 and the second insulative block 3*b*, and includes a third base 31*c*, and a third mating tongue 32*c* extending forwardly from the third base 31*c*. The first base 31*a*, the second base 31*b* and the third base 31*c* commonly form the base 11. The first mating tongue 32*a*, the second mating tongue 32*b* and the third mating tongue 32*c* commonly form the mating tongue 12. A portion commonly related to the blade 51 and the extension 52 and the mounting legs 53 is exposed outside of the base 11. The extension 52 is exposed upon the mating surface 121.

Referring to FIGS. 5-9, the electrical connector 100' has the similar structure with the electrical connector 100 except the shielding plate 4. The shielding plate 4' includes a first shielding plate 4*a*' and a second shielding plate 4*b*'. The first shielding plate 4*a* includes the main body 41', a pair of fixing legs 42', and a thinned area 45' which is recessed. The first spring tangs 411*a*' are formed in the thinned area 45'. The second shielding plate 4*b*' is dimensioned similar to the thinned area 45', and soldered to the thinned area 45'. The first spring tangs 411*a*' is located on a front portion of thinned area while the second spring tangs 411*b* are located on a rear portion of the second shielding plate 4*b* so as to have the first spring tangs offset from the second sprint tangs in the front-to-back direction. Therefore, the opening 412*a*' is covered by the second shielding plate 4*b*', and the opening 412*b*' is covered by the first shielding plate 4*a*'. The second shielding plate 4*b*' is also thinned so as to cooperate with the thinned area 45' to be equal to the thickness of the first shielding plate 4*a*'. In this embodiment, each of the thinned area 45' and the second shielding plate 4*b*' is one half of that of the first shielding plate 4*a'*.

Figure 10:
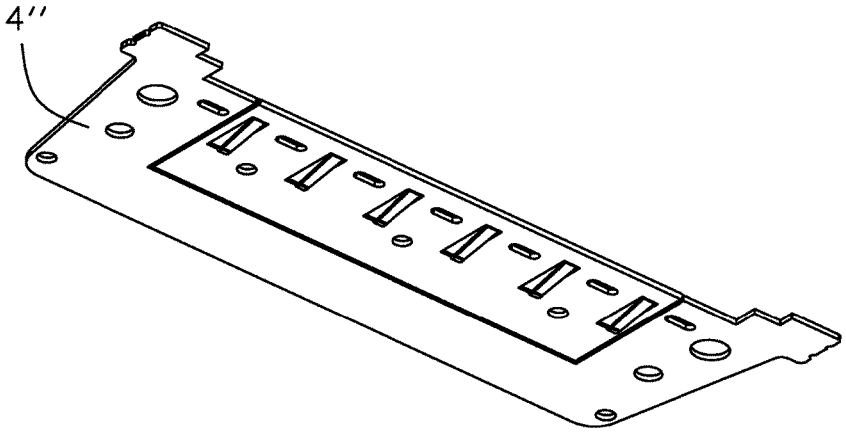
FIG. 10 is a perspective view of a third embodiment of the shielding plates of the invention.
Figure 11:
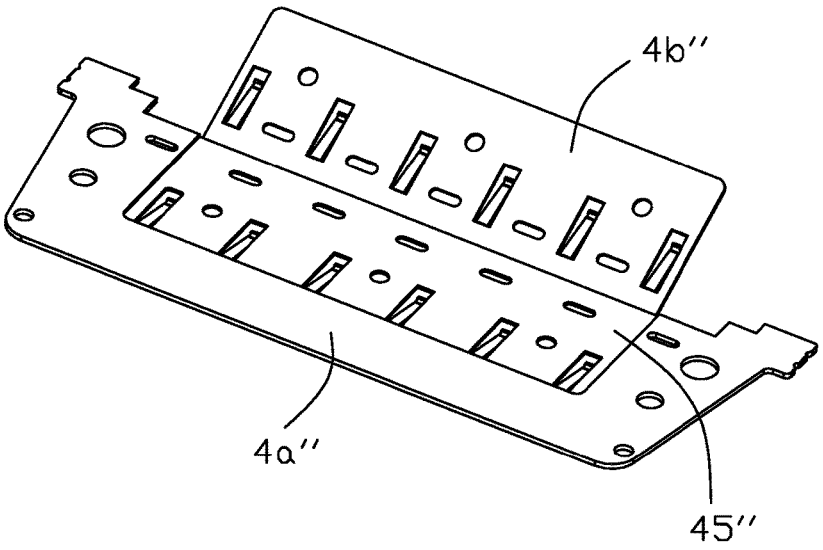
FIG. 11 is a perspective view of the preformed shielding plates of the electrical connector of FIG. 10.

FIGS. 10-11 show the third embodiment wherein the electrical connector 100" is similar to the electrical connector 100' of the second embodiment except the second shielding plate 4*b*" unitarily extends from the thinned area 45" with the same thickness which is essentially one half of that of the first shielding plate 4*a*". The second shielding plate 4*b*" is folded into the recess in the thinned area 45" and soldered thereto.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

a first contact module with a plurality of first contact retained therein in a transverse direction via an insert-molding process and including a plurality of first grounding contacts thereof;

a second contact module with a plurality of second contacts retained therein in the transverse direction via another insert-molding process and having a plurality of second grounding contacts thereof; and opposite metallic first and second shielding plates stacked with each other and commonly sandwiched between the first contact module and the second contact module in a vertical direction perpendicular to the transverse direction; wherein the first shielding plate forms a plurality of first spring tangs in one row and extending toward and contacting the corresponding first grounding contact, and the second shielding plate forms a plurality of first spring tangs in another row and extending toward and contacting the corresponding second grounding contact; wherein the first spring tangs are offset from the second sprint tangs in a front-to-back direction perpendicular to both the vertical direction and the transverse direction.

2. The electrical connector as claimed in claim 1, wherein the first shielding plate forms a plurality of openings derived from the first spring tangs and covered by the second shielding plate in the vertical direction, and the second shielding plate forms a plurality of opening derived from the second spring tangs and covered by the first shielding plate in the vertical direction.

3. The electrical connector as claimed in claim 1, wherein the first spring tangs and the second spring tangs extend in opposite directions along the front-to-back direction.

4. The electrical connector as claimed in claim 3, wherein the first spring tangs and the second spring tangs extend toward each other in the front-to-back direction.

5. The electrical connector as claimed in claim 4, wherein each of said first contacts and said second contacts includes a front contacting section, a rear tail section and a connecting section therebetween, and both the first sprint tang and said second spring tang contact the connecting section of the corresponding first contact and second contact, respectively.

6. The electrical connector as claimed in claim 1, wherein the first shielding plate forms a plurality of holes aligned with those formed in the first contact module in the vertical direction.

7. The electrical connector as claimed in claim 1, wherein the first shielding plate forms a plurality of holes aligned with those formed in the second shielding plate in the vertical direction.

8. The electrical connector as claimed in claim 1, wherein the first shielding plate forms a thinned area to receive the thinned second shielding plate therein.

9. The electrical connector as claimed in claim 8, wherein said second shielding plate unitarily extends from an edge of the thinned area.

10. The electrical connector as claimed in claim 9, wherein both the thinned area and the second shielding plate defines a thickness being one half of that of the first shielding plate.

11. The electrical connector as claimed in claim 8, wherein the first spring tangs are formed in the thinned area.

12. An electrical connector comprising:

an insulative housing having a base and a mating tongue forwardly extending from the base;

a plurality of first contacts arranged in a first row along a transverse direction and commonly retained in the housing;

a plurality of second contacts arranged in a second row along said transverse direction and commonly retaining in the housing;

opposite metallic first and second shielding plates stacked with each other and commonly sandwiched between the first contact module and the second contact module in a vertical direction perpendicular to the transverse direction; wherein the first shielding plate forms a plurality of first spring tangs in one row and extending toward and contacting the corresponding first grounding contact, and the second shielding plate forms a plurality of first spring tangs in another row and extending toward and contacting the corresponding second grounding contact; wherein the first spring tangs are offset from the second sprint tangs in a front-to-back direction perpendicular to both the vertical direction and the transverse direction.

13. The electrical connector as claimed in claim 12, wherein the first shielding plate forms a plurality of openings derived from the first spring tangs and covered by the second shielding plate in the vertical direction, and the second shielding plate forms a plurality of opening derived from the second spring tangs and covered by the first shielding plate in the vertical direction.

14. The electrical connector as claimed in claim 12, wherein the first spring tangs and the second spring tangs extend in opposite directions along the front-to-back direction.

15. The electrical connector as claimed in claim 14, wherein the first spring tangs and the second spring tangs extend toward each other in the front-to-back direction.

16. The electrical connector as claimed in claim 15, wherein each of said first contacts and said second contacts includes a front contacting section, a rear tail section and a connecting section therebetween, and both the first sprint tang and said second spring tang contact the connecting section of the corresponding first contact and second contact, respectively.

17. An electrical connector comprising:

a first contact module with a plurality of first contact retained therein in a transverse direction via an insert-molding process and including a plurality of first grounding contacts thereof;

a second contact module with a plurality of second contacts retained therein in the transverse direction via another insert-molding process and having a plurality of second grounding contacts thereof; and opposite metallic first and second shielding plates stacked with each other and commonly sandwiched between the first contact module and the second contact module in a vertical direction perpendicular to the transverse direction; wherein the first shielding plate forms a plurality of first spring tangs in one row and extending toward and contacting the corresponding first grounding contact, and the second shielding plate forms a plurality of first spring tangs in another row and extending toward and contacting the corresponding second grounding contact; wherein the first shielding plate forms a thinned area to receive the thinned second shielding plate therein.

18. The electrical connector as claimed in claim 17, wherein said second shielding plate unitarily extends from an edge of the thinned area.

19. The electrical connector as claimed in claim 18, wherein both the thinned area and the second shielding plate defines a thickness being one half of that of the first shielding plate.

20. The electrical connector as claimed in claim 17, wherein the first shielding plate forms a plurality of holes aligned with those formed in the second shielding plate in the vertical direction.

* * * * *